US011484177B2

(12) United States Patent
Brandewie et al.

(10) Patent No.: US 11,484,177 B2
(45) Date of Patent: Nov. 1, 2022

(54) DISHWASHER APPLIANCE WATER VALVE MOUNTING BRACKET

(71) Applicant: Haier US Appliance Solutions, Inc., Wilmington, DE (US)

(72) Inventors: Kyle Joseph Brandewie, Louisville, KY (US); Jeremy Joseph Ryan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 136 days.

(21) Appl. No.: 16/736,927

(22) Filed: Jan. 8, 2020

(65) Prior Publication Data

US 2021/0204792 A1 Jul. 8, 2021

(51) Int. Cl.
*A47L 15/42* (2006.01)
*A47L 15/22* (2006.01)

(52) U.S. Cl.
CPC ..... *A47L 15/4217* (2013.01); *A47L 15/4221* (2013.01); *A47L 15/22* (2013.01)

(58) Field of Classification Search
CPC .. A47L 15/4217; A47L 15/4221; A47L 15/22; A47L 15/4272
See application file for complete search history.

(56) References Cited

U.S. PATENT DOCUMENTS

| | | | |
|---|---|---|---|
| 5,582,199 | A | 12/1996 | Schmidt et al. |
| 9,402,527 | B2 | 8/2016 | Burkhard et al. |
| 9,593,790 | B2 | 3/2017 | Hite |
| 2016/0265703 | A1* | 9/2016 | Hite ..... F16L 29/007 |

OTHER PUBLICATIONS

NPL-1 https://www.youtube.com/watch?v=LKAKoFzVGhk (Year: 2015).*
NPL-2 https://millenniumracks.com/index.php?route=product/category&path=21 (Year: 2018).*
NPL-3 https://www.amazon.com/Samsung-DD81-02265A-Dishwasher-Equipment-Manufacturer/dp/B07CT53VJ6/ref=sr_1_9?dchild=1&keywords=Whirlpool+WD15X22999+Dishwasher+Water+Inlet+Valve+WD15X22999&qid=1633728275&s=hi&sr=1-9#customerReviews (Year: 2018).*
NPL-4 https://www.amazon.com/Keadic-Bracket-Stainless-Tension-Assortment/dp/B07H254472/ref=sr_1_2?crid=QUL6281DIVFO&dchild=1&keywords=tube+bracket+1+inch&qid=1633742133&s=hi&sprefix=tube+bracket+%2Ctools%2C161&sr=1-2 (Year: 2018).*
Whirlpool Dishwasher Repair—How to Replace the Water Inlet Valve, https://www.youtube.com/watch?v=NIwFZzvOYko.

* cited by examiner

*Primary Examiner* — Michael E Barr
*Assistant Examiner* — Pallavi Chitta
(74) *Attorney, Agent, or Firm* — Doritv & Manning, P.A.

(57) ABSTRACT

A water valve bracket for a dishwasher appliance is provided. The dishwasher appliance includes a base rail having a curvilinear cross-sectional shape. The water valve bracket includes a curvilinear flange which is configured to mount on the base rail with the curvilinear flange in contact with the base rail. A curvature of the curvilinear flange of the water valve bracket conforms to the curvilinear cross-sectional shape of the base rail.

14 Claims, 9 Drawing Sheets

DISHWASHER APPLIANCE WATER VALVE MOUNTING BRACKET

FIELD OF THE INVENTION

The subject matter of the present disclosure relates generally to dishwasher appliances, and more particularly to dishwasher appliances with improved valve mounting features.

BACKGROUND OF THE INVENTION

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

Dishwasher appliances further typically include a fluid circulation system which is in fluid communication with the spray assemblies for circulating fluid to the spray assemblies. The fluid circulation system generally receives fluid from the wash chamber, filters soil from the fluid, and flows the filtered fluid to the spray assemblies. Additionally, unfiltered fluid can be flowed to a drain as required.

Dishwasher appliance, e.g., the fluid circulation systems thereof, typically receive water, such as for an initial fill or a rinse cycle, etc., from a water supply via a valve. As such, the water valve must be mounted within the dishwasher appliance and connected to other components within the dishwasher appliance, such as conduits of the fluid circulation system.

However, interior space within the dishwasher appliance is often at a premium. Moreover, it can be difficult to properly locate the water within the dishwasher appliance, such as to create or maintain a liquid-tight connection between the water valve and the water supply and/or the conduit(s) of the dishwasher appliance.

Accordingly, improved water valve mounting structures for dishwasher appliances are desired.

BRIEF DESCRIPTION OF THE INVENTION

Aspects and advantages of the invention will be set forth in part in the following description, or may be obvious from the description, or may be learned through practice of the invention.

In accordance with one embodiment, a dishwasher appliance is provided. The dishwasher appliance includes a tub that defines a wash chamber and a door rotatably mounted to the tub at a front opening of the tub. The door is movable between a closed position where the wash chamber is sealingly enclosed and an open position which permits access to the wash chamber through the front opening. The dishwasher appliance also includes a base rail connected to the tub and to the door. The base rail has a curvilinear cross-sectional shape. A water valve bracket is mounted to the base rail, the water valve bracket comprising a curvilinear flange in contact with the base rail, wherein a curvature of the curvilinear flange of the water valve bracket conforms to the curvilinear cross-sectional shape of the base rail In accordance with another embodiment, a water valve bracket for a dishwasher appliance is provided. The dishwasher appliance includes a base rail having a curvilinear cross-sectional shape. The water valve bracket includes a curvilinear flange which is configured to mount on the base rail with the curvilinear flange in contact with the base rail. A curvature of the curvilinear flange of the water valve bracket conforms to the curvilinear cross-sectional shape of the base rail.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures.

DETAILED DESCRIPTION OF THE INVENTION

Figure 1:
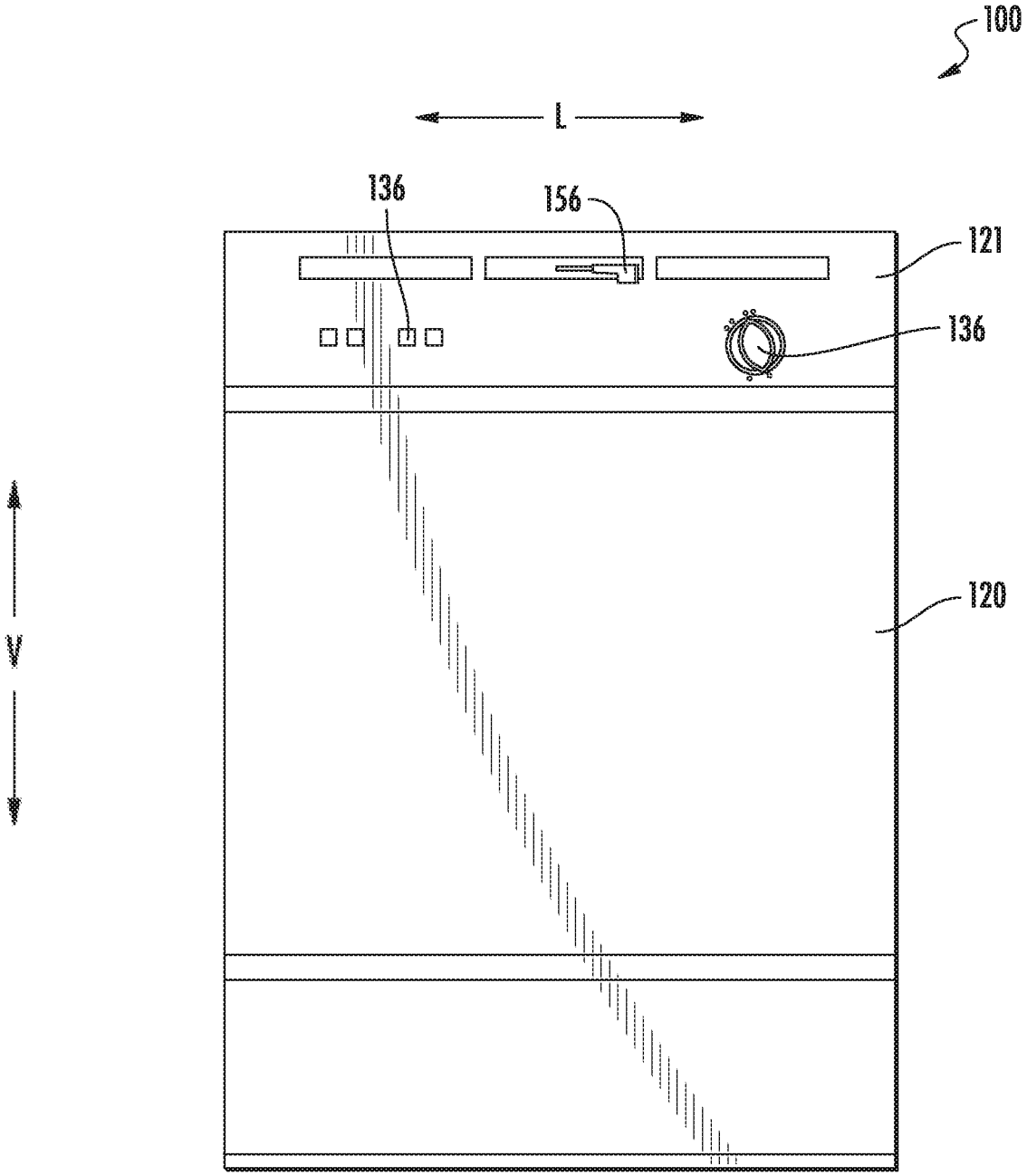
FIG. 1 provides a front view of a dishwasher appliance in accordance with one or more embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
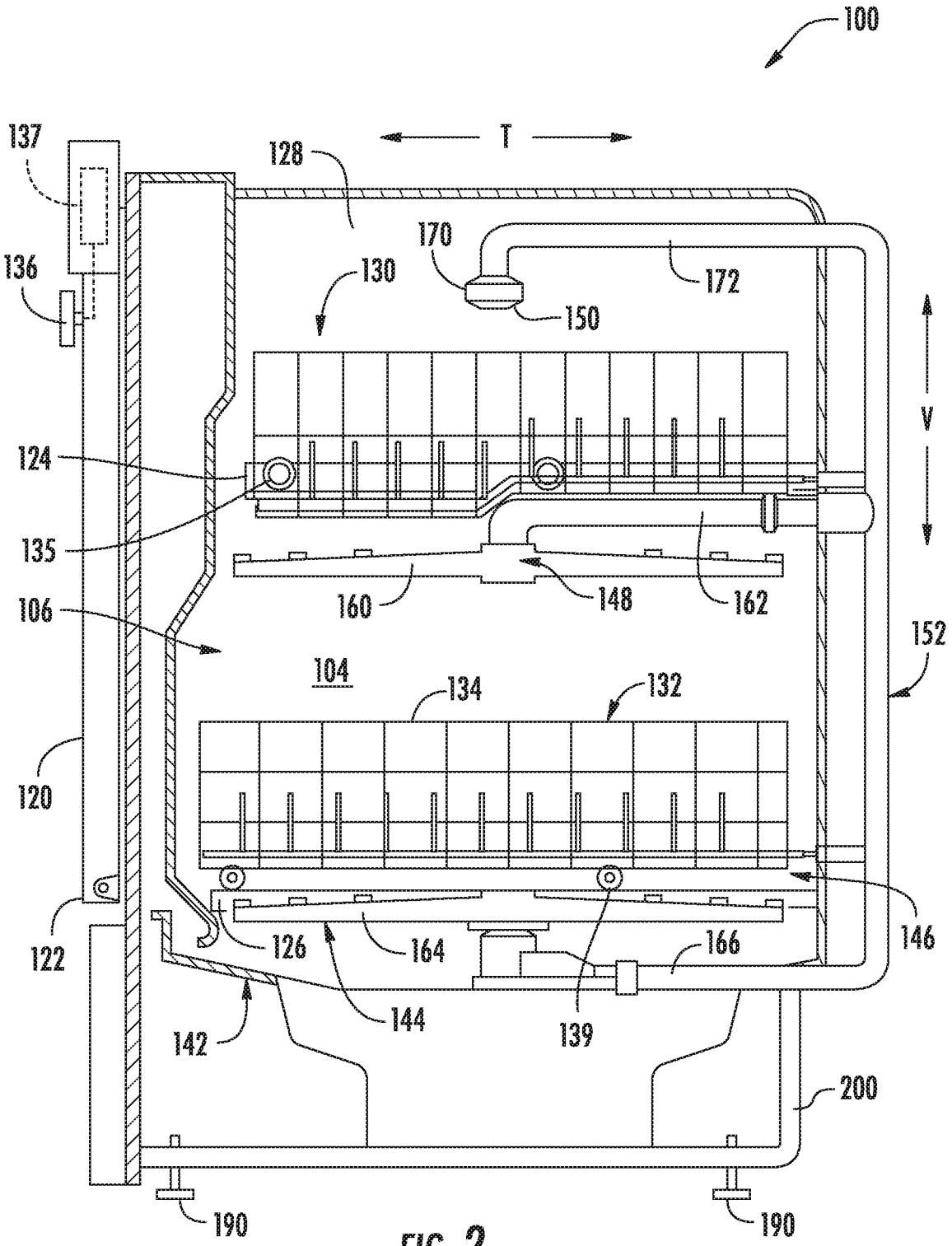
FIG. 2 provides a side, partially cross-sectioned view of a dishwasher appliance in accordance with one or more embodiments of the present disclosure.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a tub 104 therein that defines a wash chamber 106. As shown, the dishwasher appliance 100 defines a vertical direction V, a lateral direction L, and a transverse direction T, which are mutually orthogonal and define a coordinate system for the dishwasher appliance. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. A latch 156 may be used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a bottom wall 142 of the tub 104 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

Each spray arm-assembly 144 may include a spray arm and a conduit in fluid communication with the spray arm, for providing a fluid flow to the spray arm. For example, mid-level spray-arm assembly 148 may include a spray arm 160 and a conduit 162. Lower spray-arm assembly 144 may include a spray arm 164 and a conduit 166. Additionally, upper spray assembly 150 may include a spray head 170 and a conduit 172 in fluid communication with the spray head 170.

The lower and mid-level spray-arm assemblies 144, 148 and the upper spray assembly 150 are part of a fluid circulation system 152 for circulating fluid in the dishwasher appliance 100. The fluid circulation system 152 also includes various components for receiving fluid from the wash chamber 106, filtering the fluid, and flowing the fluid to the various spray assemblies such as the lower and mid-level spray-arm assemblies 144, 148 and the upper spray assembly 150. Such components can be generally positioned within a machinery compartment below the bottom wall 142 and in communication with the wash chamber 106.

The dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different combinations of spray assemblies may be utilized, and other differences may be applied as well.

As may be seen in FIG. 2, the dishwasher appliance 100 may include a base rail 200 which provides a structural support and brace for other components of the dishwasher appliance 100. For example, the base rail 200 may be connected to the tub 104 and to the door 120. In some embodiments, the base rail 200 may be directly connected to the tub 104 and the door 120. In other embodiments, the base rail 200 may be indirectly connected to one or both of the tub 104 and the door 120. For example, the base rail 200 may be connected to the door 120 via one or more intermediate components, such as an offset leg at the front of the dishwasher appliance 100 and/or the tub 104. Also illustrated by way of example in FIG. 2 are a plurality of support feet 190 which may be attached, e.g., mounted, to the base rail 200. The support feet 190 may contact a floor or ground surface beneath the dishwasher appliance 100 and may serve for locating, supporting, and/or levelling the dishwasher appliance 100.

Figure 3:
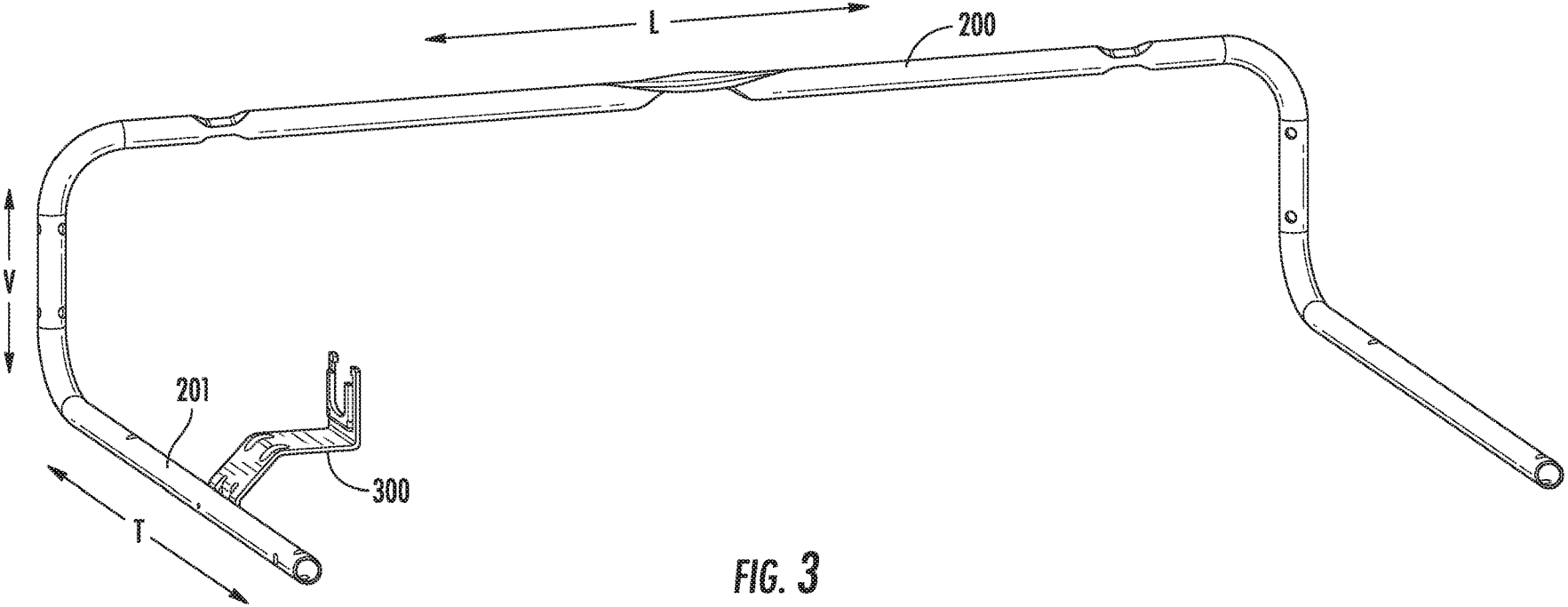
FIG. 3 provides a perspective view of a tubular base rail and a water valve mounting bracket for a dishwasher appliance in accordance with one or more embodiments of the present disclosure.

FIG. 3 provides a perspective view of the example base rail 200 with a water valve bracket 300 mounted to the base rail 200. As may be seen, e.g., in FIG. 3, in some embodiments the base rail 200 may be tubular, e.g., hollow. For example, the base rail 200 may be tubular steel or other suitable material. Also as may be seen in FIG. 3, the base rail 200 may have or define a curvilinear cross-sectional shape, such as a circular cross-sectional shape, as in the illustrated example embodiments. In other embodiments, the base rail 200 may have, for example, an elliptical cross-sectional shape or an asymmetrical curvilinear cross-sectional shape.

As may be seen generally in FIGS. 4 through 7, the water valve bracket 300 may include a curvilinear flange 302 which is in contact with the base rail 200 when the water valve bracket 300 is mounted to the base rail 200. In some embodiments, a curvature of the curvilinear flange 302 of the water valve bracket 300 may conform to the curvilinear cross-sectional shape of the base rail 200. Tus, when the water valve bracket 300 is mounted on the base rail 200, the curvilinear flange 302 of the water valve bracket 300 may be in contact with, such as in direct contact with, the base rail 200 continuously along an entire length, e.g., an entire arc length, of the curvilinear flange 302. As just one possible example of complementary or conforming curvature, in embodiments where the base rail 200 has a circular cross-sectional shape, the curvilinear flange 302 of the water valve bracket 300 may define a circular arc. In such embodiments, the circular arc defined by the curvilinear flange 302 may be concentric with the circular cross-sectional shape of the base rail 200 and the radius of the circular arc may be slightly greater than the radius of the circular cross-sectional shape of the base rail 200, "slightly greater" in this context meaning that the larger radius of the curvilinear flange 302 permits the flange 302 to snugly encompass the curvilinear, e.g., circular, base rail 200, such as with the curvilinear flange 302 radially outward of the base rail 200 and in continuous direct contact with the base rail 200 across the length of the flange 302.

Still referring to FIGS. 4 through 7, the dishwasher appliance 100 may also include a slot 202 defined in the base rail 200. In such embodiments, the water valve bracket 300 may include a tab 304 and the tab 304 may be received within the slot 202 of the base rail 200. For example, as may be seen in FIG. 3, the water valve 300 may be mounted to the base rail 200 at a leg 201 of the base rail 200. The leg 201 may extend horizontally, e.g., generally perpendicular to the vertical direction V, such as generally along the transverse direction T. The slot 202 may be oriented generally along the transverse direction T. For example, the slot 202 may be oblong and may have a minor axis or dimension and a major axis or dimension. For example, the slot 202 may be shaped as a non-square rectangle, an ellipse, or a stadium (e.g., a rectangle with semicircles at a pair of opposite sides, also known as a discorectangle or obround). Thus, in various embodiments, the slot 202 may be oriented generally along the transverse direction T in that the major axis of the slot 202 is oriented generally along the transverse direction T. In such embodiments, the major axis of the slot 202 may define a width 203 (FIG. 5) of the slot 202 generally along the transverse direction T, and the tab 304 of the water valve bracket 300 may define a width 308 generally parallel to the width of the slot 202, e.g., generally along the transverse direction T. As illustrated, the width 308 of the tab 304 may be less than the width 203 of the slot 202, such that the tab 304 may be received in the slot 202.

In some embodiments, the tab 304 may be a first tab, e.g., the water valve bracket 300 may include the first tab 304 and a second tab 306. The second tab 306 may be disposed opposite the first tab 304 with respect to the curvilinear flange 302. For example, the curvilinear flange 302 of the water valve bracket 300 may be disposed between the first tab 304 and the second tab 306. The second tab 306 may be received in a second slot 204 of the base rail 200.

Figure 8:
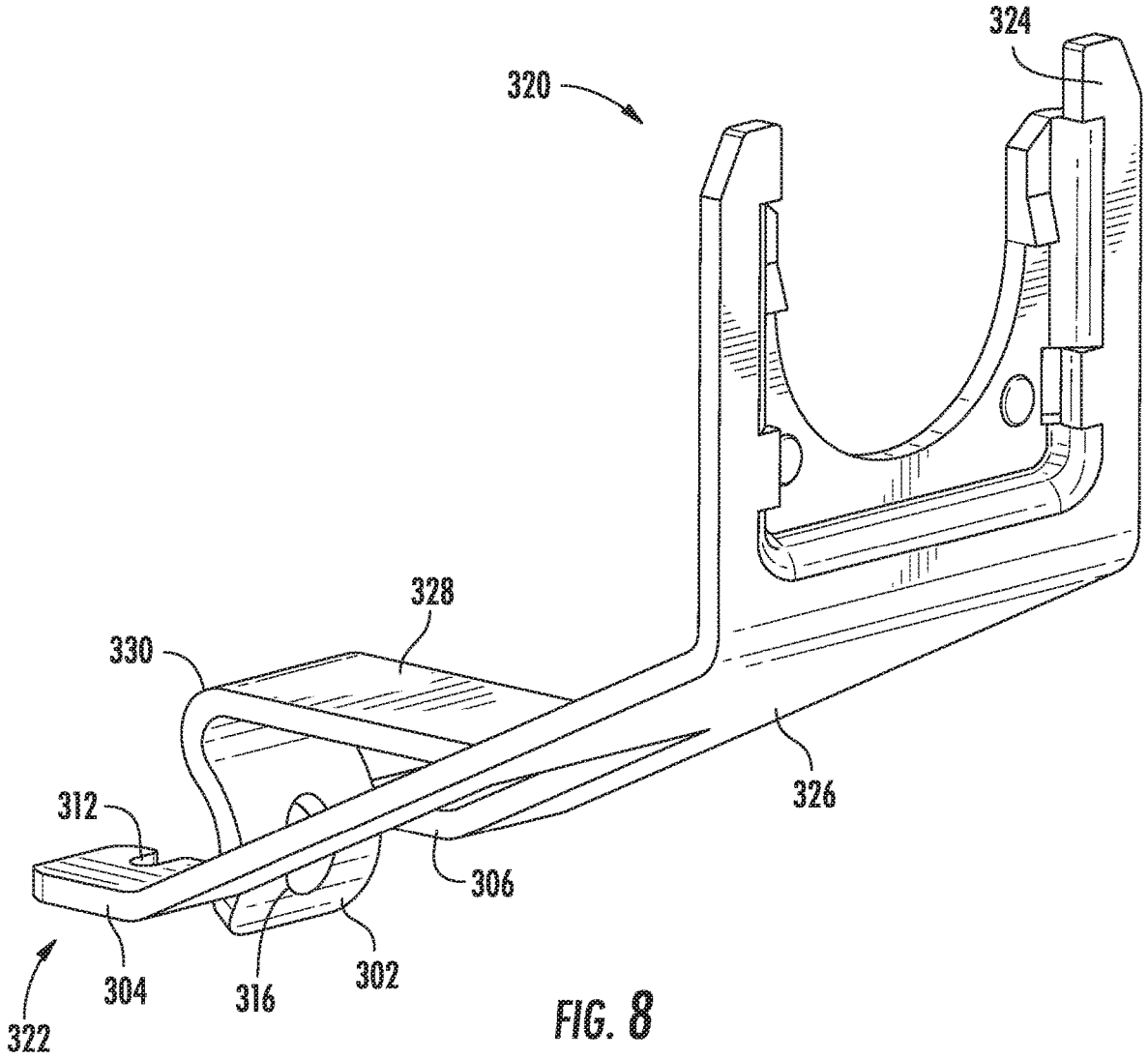
FIG. 8 provides a perspective view of a water valve mounting bracket for a dishwasher appliance in accordance with one or more embodiments of the present disclosure.
Figure 9:
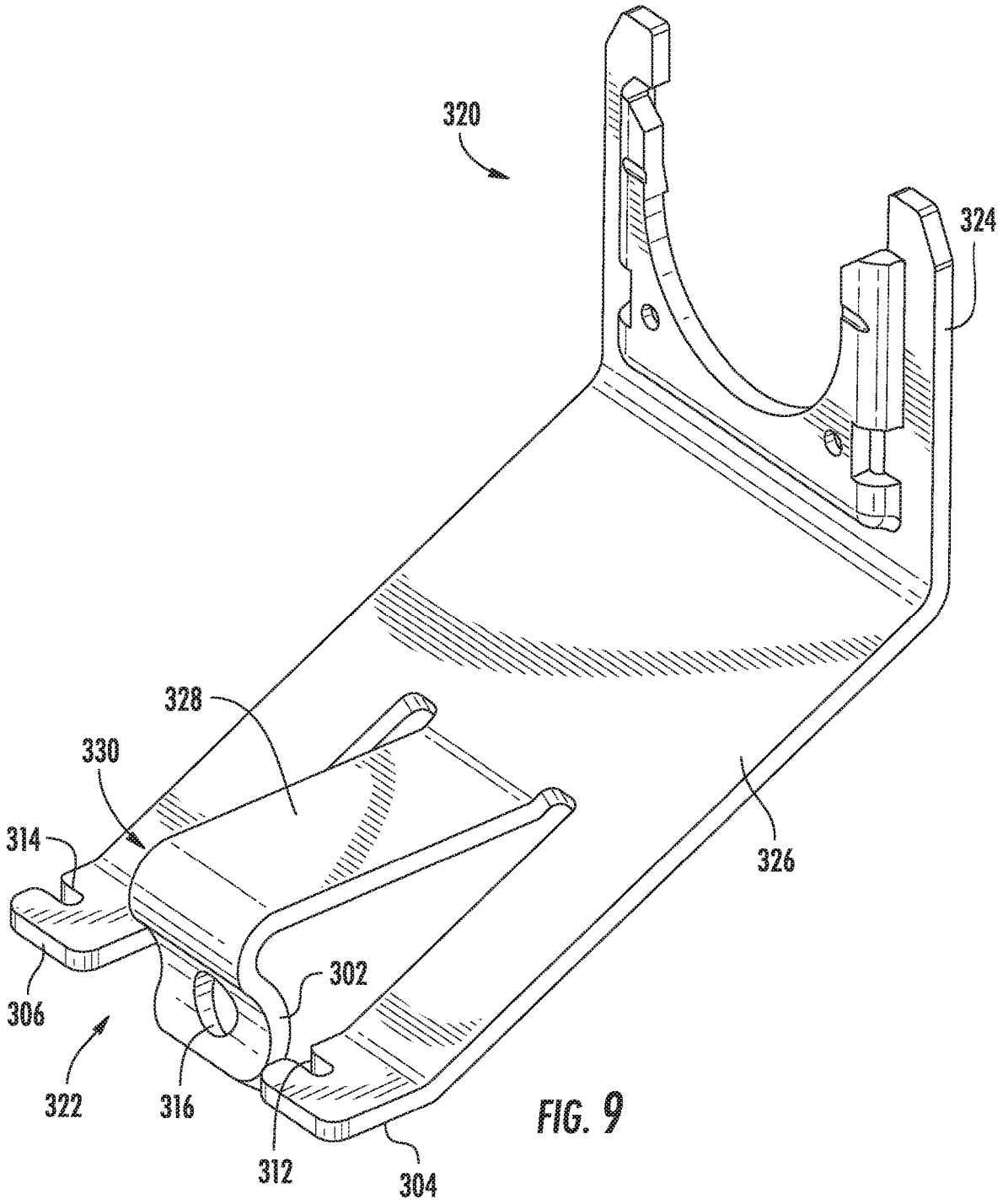
FIG. 9 provides another perspective view of the water valve mounting bracket of FIG. 8.

As may be seen in FIGS. 8 and 9, the first tab 304 and the second tab 306 may each include a hook 312 and 314, respectively. The hook 312 of the first tab 304 may be configured to engage an edge 206 of the first slot 202 and the hook 314 of the second tab 306 may be configured to engage an edge 208 of the second slot 204. In such embodiments, the water valve bracket 300 may be mountable on the base rail 200 by inserting the tabs 304 and 306 into the respective slots 202 and 204 and then sliding the water valve bracket 300 such that the hooks 312 and 314 on each tab 304 and 306 each engage an edge 206, 208 of the respective slot 202, 204. For example, the hooks 312 and 314 may be brought into engagement with the edges 206 and 208 by moving the water valve bracket 300 generally along the transverse direction T, such as towards the back of the dishwasher appliance 100 generally along the transverse direction T, such as to the right on the page as illustrated in FIGS. 4 and 5.

Figure 4:
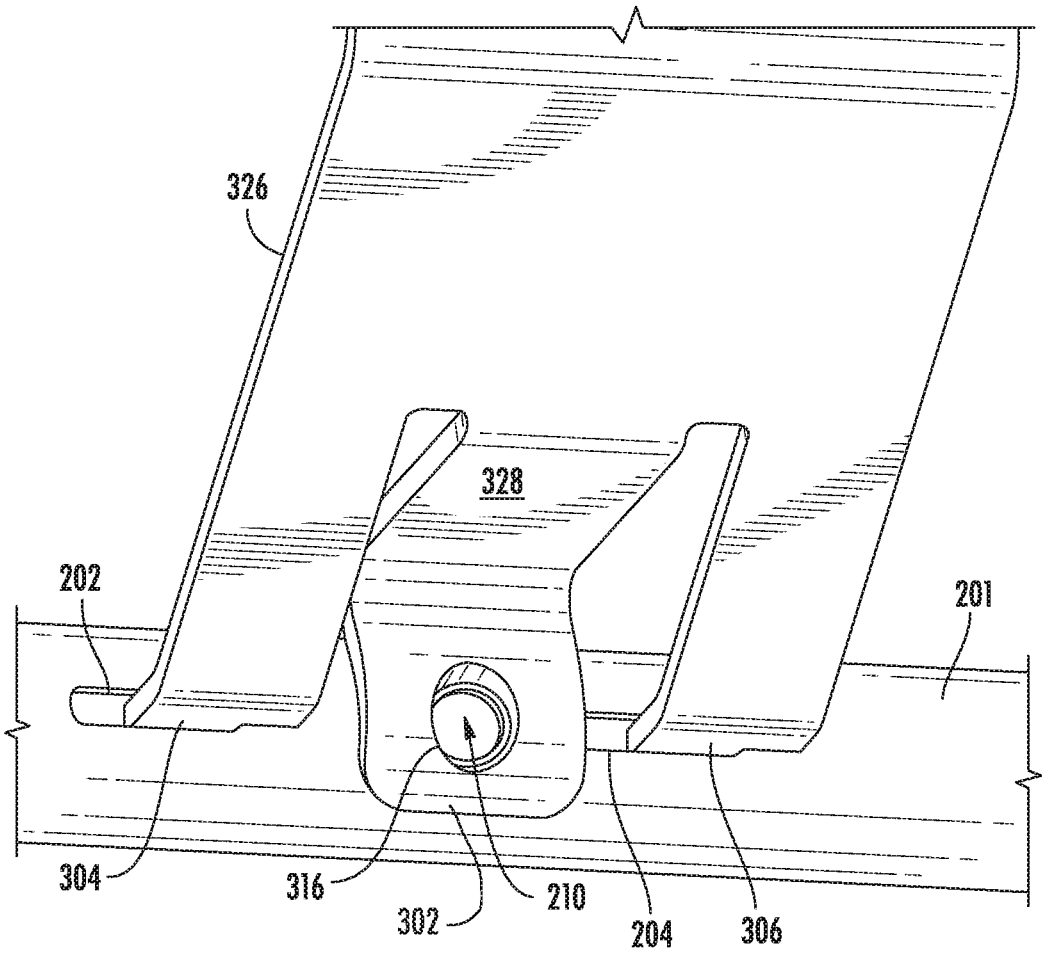
FIG. 4 provides an enlarged view of a portion of the base rail and bracket of FIG. 3.
Figure 5:
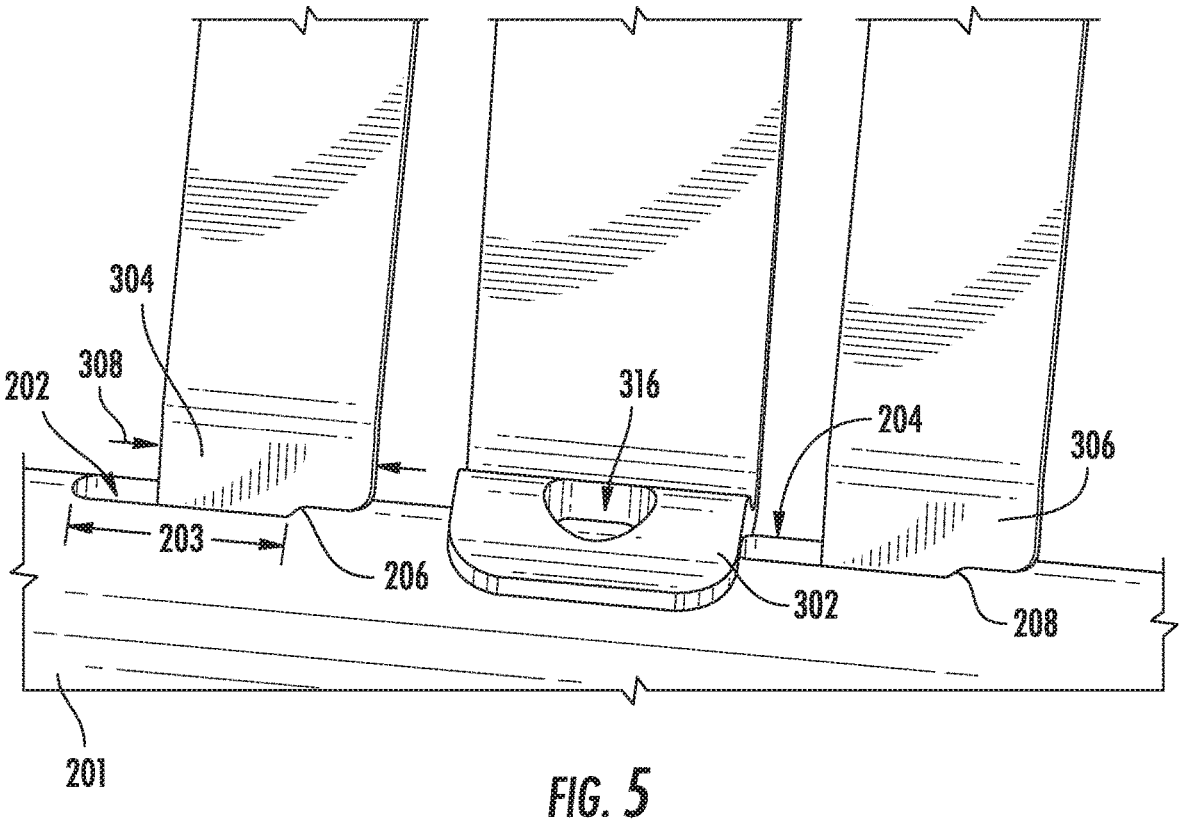
FIG. 5 provides an enlarged view of a portion of the base rail and bracket of FIG. 3.
Figure 6:
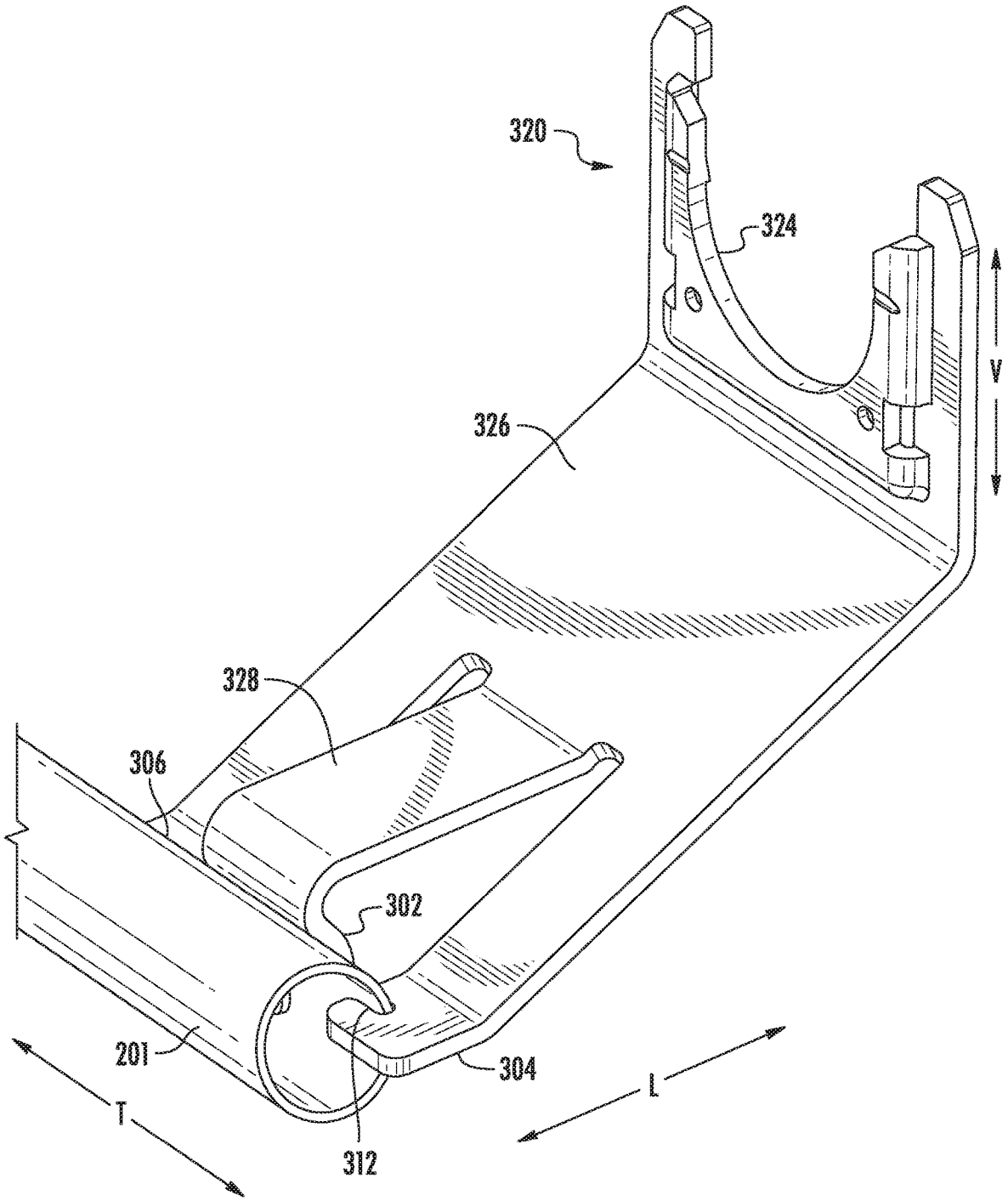
FIG. 6 provides a partially sectioned perspective view of the base rail and bracket of FIG. 3.
Figure 7:
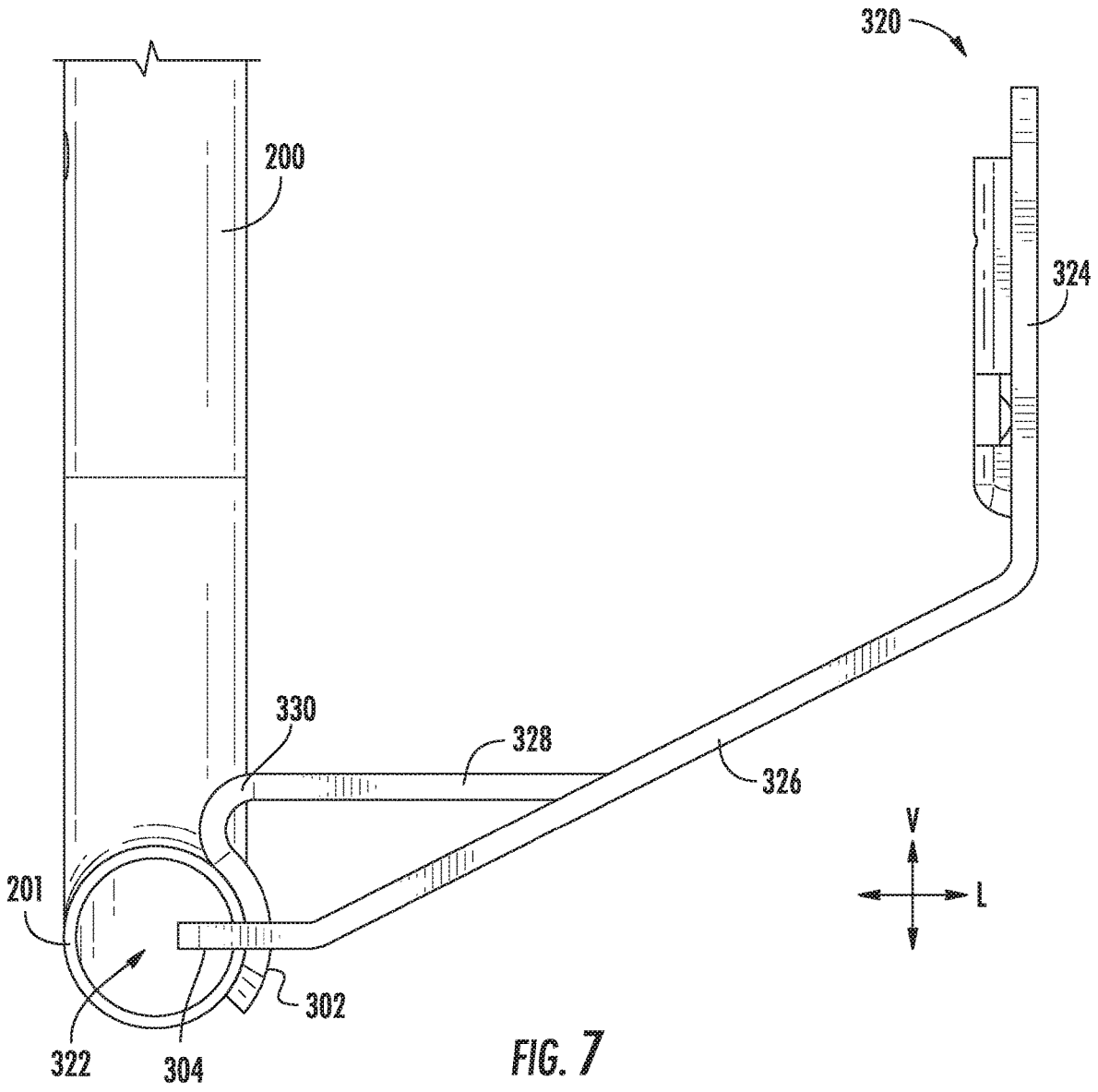
FIG. 7 provides a partially sectioned orthogonal view of the base rail and bracket of FIG. 3.

As may be seen, for example in FIGS. 4 and 5, in some embodiments, the water valve bracket 300 may include a hole 316 extending through the curvilinear flange 302. In such embodiments, the base rail 200 may include an aperture 210. When the water valve bracket 300 is mounted on the base rail 200, e.g., when the hooks 312 and 314 are engaged with the edges 206 and 208 of the slots 202 and 204, the hole 316 in the curvilinear flange 302 of the water valve bracket 300 and the aperture 210 of the base rail 200 may be aligned, such as concentrically aligned. In some embodiments, a threaded fastener such as a screw or bolt may be provided and may extend through the hole 316 and the aperture 210 in order to further secure the water valve bracket 300 to the base rail 200. Such threaded fasteners are understood by those of skill in the art and, as such, are not illustrated or described in further detail herein for the sake of clarity and brevity.

Turning now particularly to FIGS. 8 and 9, the water valve bracket 300 may extend from a first end 320 to a second end 322. The water valve bracket 300 may include a fork 324 at the first end 320 for receiving a water valve and the curvilinear flange 302 of the water valve bracket 300 may be defined at the second end 322 of the water valve bracket 300. As may be seen in FIGS. 3 through 9, the water valve bracket 300 may include an oblique portion 326 extending from the fork 324 and a finger 328 extending from the oblique portion 326. In such embodiments, the curvilinear flange 302 of the water valve bracket 300 may be defined at an end 330 of the finger 328.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance defining a vertical direction, a lateral direction, and a transverse direction, the vertical, lateral, and transverse directions being mutually perpendicular, the dishwasher appliance comprising:

a tub that defines a wash chamber;

a door rotatably mounted to the tub at a front opening of the tub, the door movable between a closed position where the wash chamber is sealingly enclosed and an open position which permits access to the wash chamber through the front opening;

a base rail connected to the tub and to the door, the base rail comprising a curvilinear cross-sectional shape; and a water valve bracket mounted to the base rail, the water valve bracket extending from a first end to a second end, the water valve bracket comprising a fork at the first end for receiving a water valve and a tab at the second end, the fork oriented generally along the vertical direction and the tab oriented generally perpendicularly to the fork, the water valve bracket further comprising an oblique portion extending from the fork at an upper end of the oblique portion to the tab at a lower end of the oblique portion, a finger extending from an intermediate region on the oblique portion between the upper end and the lower end, the finger oriented generally perpendicularly to the vertical direction, and a curvilinear flange defined at an end of the finger opposite the oblique portion, the curvilinear flange in contact with the base rail, wherein a curvature of the curvilinear flange of the water valve bracket conforms to the curvilinear cross-sectional shape of the base rail.

2. The dishwasher appliance of claim 1, further comprising a slot defined in the base rail, wherein the tab of the water valve bracket is received within the slot of the base rail.

3. The dishwasher appliance of claim 2, wherein the tab of the water valve bracket comprises a hook engaged with an edge of the slot of the base rail.

4. The dishwasher appliance of claim 2, wherein the tab of the water valve bracket is a first tab of the water valve bracket, further comprising a second tab of the water valve bracket opposite the first tab with the curvilinear flange of the water valve bracket between the first tab and the second tab.

5. The dishwasher appliance of claim 1, wherein the curvilinear cross-sectional shape of the base rail is circular.

6. The dishwasher appliance of claim 1, wherein the base rail is tubular.

7. The dishwasher appliance of claim 1, further comprising a hole extending through the curvilinear flange of the water valve bracket and an aperture in the base rail, wherein the hole and the aperture are aligned.

8. The dishwasher appliance of claim 7, further comprising a threaded fastener extending through the hole and the aperture.

9. A water valve bracket for a dishwasher appliance, the water valve bracket defining a vertical direction, a lateral direction, and a transverse direction, the vertical, lateral, and transverse directions being mutually perpendicular, the dishwasher appliance comprising a base rail having a curvilinear cross-sectional shape, the water valve bracket extending from a first end to a second end, the water valve bracket comprising:

a fork at the first end for receiving a water valve, the fork oriented generally along the vertical direction;

a tab at the second end, the tab oriented generally perpendicularly to the fork;

an oblique portion extending from the fork at an upper end of the oblique portion to the tab at a lower end of the oblique portion;

a finger extending from an intermediate region on the oblique portion between the upper end and the lower end, the finger oriented generally perpendicularly to the vertical direction; and a curvilinear flange defined at an end of the finger opposite the oblique portion, the curvilinear flange configured to mount on the base rail whereby the curvilinear flange is in contact with the base rail;

wherein a curvature of the curvilinear flange of the water valve bracket conforms to the curvilinear cross-sectional shape of the base rail.

10. The water valve bracket of claim 9, wherein the tab is configured to be received within a slot of the base rail.

11. The water valve bracket of claim 10, wherein the tab comprises a hook configured to engage with an edge of the slot of the base rail.

12. The water valve bracket of claim 10, wherein the tab is a first tab, further comprising a second tab opposite the first tab about the curvilinear flange.

13. The water valve bracket of claim 9, wherein the curvilinear flange defines a circular arc.

14. The water valve bracket of claim 9, further comprising a hole extending through the curvilinear flange of the water valve bracket and configured to align with an aperture in the base rail.

* * * * *